US010883310B2

(12) United States Patent
Johnson et al.

(10) Patent No.: US 10,883,310 B2
(45) Date of Patent: Jan. 5, 2021

(54) LADDER STABILITY ENHANCING ASSEMBLY

(71) Applicants: Benjamin Johnson, Salem, SD (US); Chad Johnson, Salem, SD (US)

(72) Inventors: Benjamin Johnson, Salem, SD (US); Chad Johnson, Salem, SD (US)

( * ) Notice: Subject to any disclaimer, the term of this patent is extended or adjusted under 35 U.S.C. 154(b) by 141 days.

(21) Appl. No.: 16/249,178

(22) Filed: Jan. 16, 2019

(65) Prior Publication Data

US 2020/0224495 A1 Jul. 16, 2020

(51) Int. Cl.
*E06C 7/48* (2006.01)
*E06C 7/18* (2006.01)

(52) U.S. Cl.
CPC ..... *E06C 7/486* (2013.01); *E06C 7/182* (2013.01); *E06C 7/48* (2013.01)

(58) Field of Classification Search
CPC ..... E06C 7/48; E06C 7/486; E06C 7/182
See application file for complete search history.

(56) References Cited

U.S. PATENT DOCUMENTS 2,140,828 A * 12/1938 Carle ..... E06C 1/36 248/238
2,439,430 A * 4/1948 Hurd ..... E06C 1/36 182/206
2,815,160 A * 12/1957 Gilmour ..... E06C 7/488 182/107
4,279,327 A * 7/1981 Warren ..... E06C 1/345 182/152
4,311,209 A 1/1982 Primerano et al.
4,548,293 A * 10/1985 Haab ..... E06C 9/02 182/106
5,012,895 A 5/1991 Santon
5,165,501 A * 11/1992 Donahey ..... E06C 7/42 182/107
6,009,974 A * 1/2000 Jones ..... E06C 7/48 182/107
6,012,546 A * 1/2000 Bee ..... E06C 7/44 182/106
6,158,549 A * 12/2000 Hartman, Jr. ..... E06C 1/36 182/206
6,394,229 B1 * 5/2002 Hastreiter ..... E06C 1/12 182/107
7,066,299 B1 * 6/2006 Fleming ..... E06C 1/20 182/107
7,322,442 B2 * 1/2008 Clark ..... E06C 7/182 182/106

(Continued)

FOREIGN PATENT DOCUMENTS

CN 10110511 5/2010
CN 201934004 10/2011

(Continued)

*Primary Examiner* — Colleen M Chavchavadze

(57) ABSTRACT

A ladder stability enhancing assembly includes a sleeve with an outer wall having an upper end and a lower end. The lower end is open and is configured to receive a top end of a ladder side rail. A coupler is mounted to the sleeve and is configured to releasable engage a ladder rung. A stabilizer is attached to the sleeve. The stabilizer is positionable on a roof to stabilize a ladder engaged with the sleeve. The stabilizer extends upwardly and forwardly of the sleeve.

8 Claims, 5 Drawing Sheets

(56) References Cited

U.S. PATENT DOCUMENTS

| | | | | |
|---|---|---|---|---|
| 7,992,681 | B2 * | 8/2011 | Anderson | E06C 5/02 182/106 |
| 8,157,056 | B2 * | 4/2012 | Feldhaus | F16B 7/042 182/107 |
| 8,235,175 | B1 * | 8/2012 | Feldhaus | E06C 7/486 182/214 |
| 8,602,163 | B2 * | 12/2013 | Davis, Jr. | E06C 7/48 182/107 |
| 8,839,907 | B2 * | 9/2014 | Davis, Jr. | E06C 7/182 182/107 |
| 8,839,908 | B2 * | 9/2014 | Davis, Jr. | E06C 7/182 182/107 |
| 9,540,875 | B2 * | 1/2017 | Ellis | E06C 1/04 |
| 9,593,531 | B2 | 3/2017 | Ballard | |
| 9,932,771 | B1 * | 4/2018 | Bramwell | E06C 7/48 |
| 2008/0190692 | A1 * | 8/2008 | Feik | E06C 7/182 182/107 |
| 2011/0011676 | A1 | 1/2011 | DeLair | |
| 2019/0257152 | A1 * | 8/2019 | MacKarvich | E06C 7/182 |

FOREIGN PATENT DOCUMENTS

| | | |
|---|---|---|
| CN | 1077191131 | 9/2017 |
| GB | 2459118 | 10/2009 |
| JP | 2008285967 | 11/2008 |

* cited by examiner 64
74
58
38
56
66
16
72
70
40
34
76
14
26
12
18

LADDER STABILITY ENHANCING ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

(2) Description of Related Art Including Information Disclosed Under 37 CFR 1.97 and 1.98

The disclosure and prior art relates to ladder support devices and more particularly pertains to a new ladder support device for preventing an upper portion of a ladder from sliding laterally off of a roof edge.

(h) BRIEF SUMMARY OF THE INVENTION

An embodiment of the disclosure meets the needs presented above by generally comprising a sleeve including an outer wall having an upper end and a lower end. The lower end is open and is configured to receive a top end of a ladder side rail. A coupler is mounted to the sleeve and is configured to releasable engage a ladder rung. A stabilizer is attached to the sleeve. The stabilizer is positionable on a roof to stabilize a ladder engaged with the sleeve. The stabilizer extends upwardly and forwardly of the sleeve.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
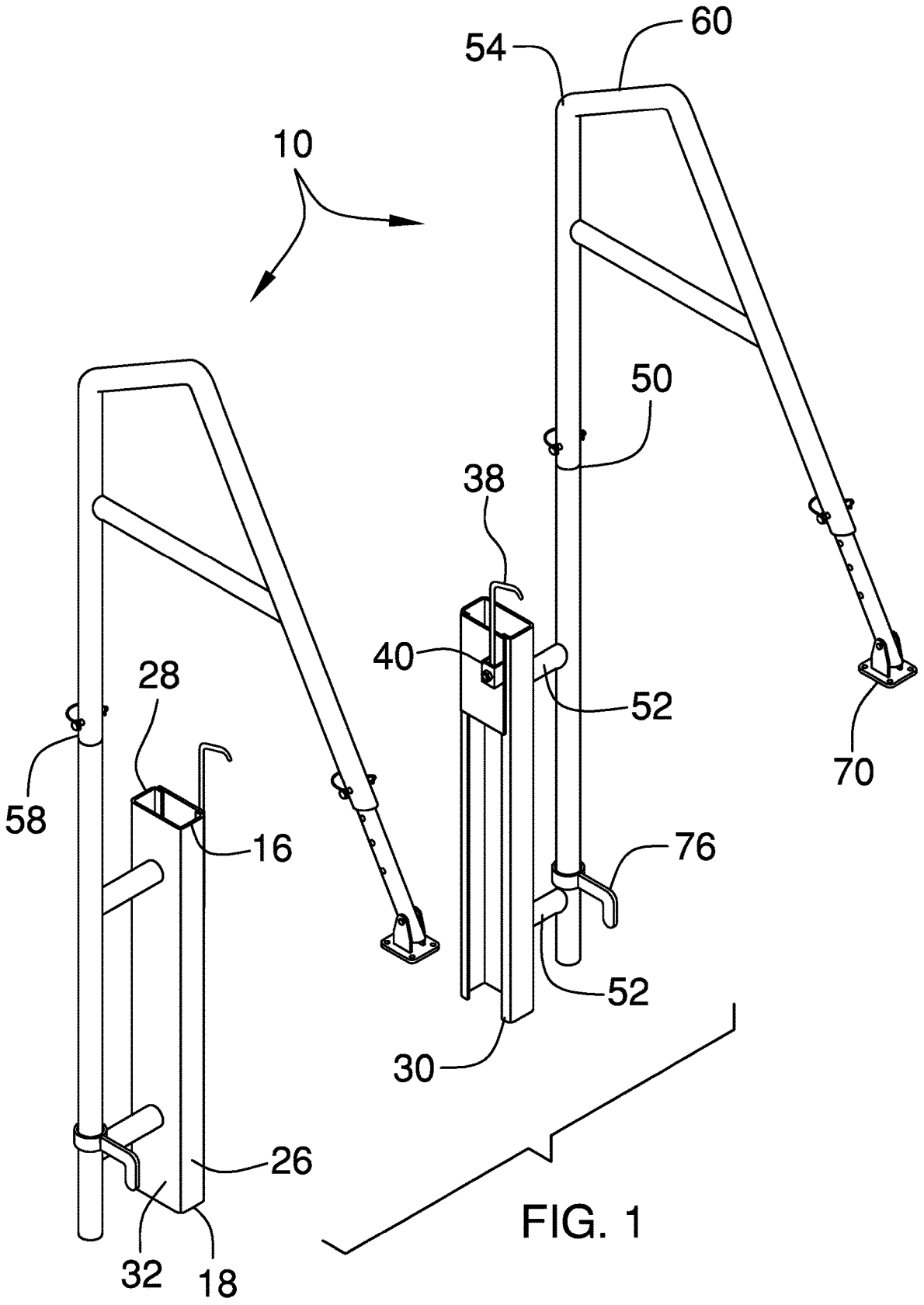
FIG. 1 is a front isometric view of a ladder stability enhancing assembly according to an embodiment of the disclosure.

With reference now to the drawings, and in particular to FIGS. 1 through 6 thereof, a new ladder support device embodying the principles and concepts of an embodiment of the disclosure and generally designated by the reference numeral 10 will be described.

As best illustrated in FIGS. 1 through 6, the ladder stability enhancing assembly 10 generally comprises a sleeve 12 that includes an outer wall 14 having an upper end 16 and a lower end 18. The lower end 18 is open and is configured to receive a top end 20 of a ladder 22 side rail 24. More specifically, the outer wall 14 forms a perimeter wall including a front wall 26, a rear wall 28, a first lateral wall 30 and a second lateral wall 32 wherein the sleeve 12 is elongated from the upper end 16 to the lower end 18. The first lateral wall 30 may have a slit therein extending through the upper 16 and lower 18 ends.

A coupler 34 is mounted to the sleeve 12. The coupler 34 is configured to releasable engage a ladder 22 rung 36 to retain the sleeve 12 at a selected position on the ladder 22. The coupler 34 is positioned nearer to the upper end 16 than the lower end 18. The coupler 34 may comprise a hook 38 that has an attached end 40 which is rotatably coupled to the sleeve 12. The hook 38 is positioned under a selected rung 36 so that the sleeve 12 cannot be pulled upwardly off of the ladder 22. The sleeve 12 itself may frictionally engage the ladder 22 in concert with the coupler 34.

A stabilizer 42 is attached to the sleeve 12 and is positionable on a roof 44 to stabilize a ladder 22 engaged with the sleeve 12. The stabilizer 42 extends upwardly and forwardly of the sleeve 12 so that it can extend over a roof gutter 46 and to an upper surface 48 of the roof 44. The stabilizer 42 is positioned on the sleeve 12 opposite of the coupler 34 wherein the coupler 34 is attached to the first lateral wall 30 and the stabilizer 42 is attached to the second lateral wall 32.

Figure 2:
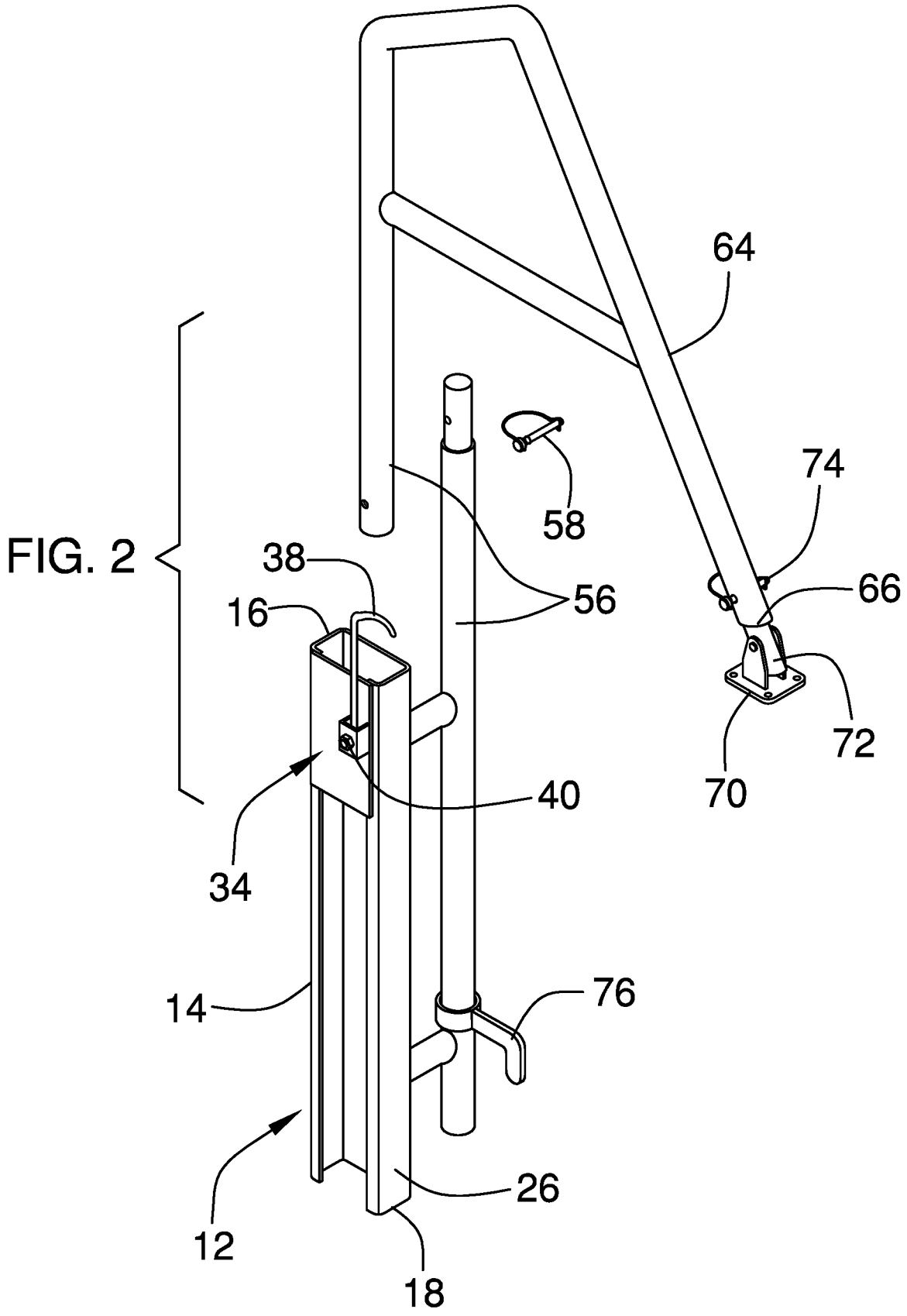
FIG. 2 is a front isometric view of an embodiment of the disclosure.
Figures 3, 4:
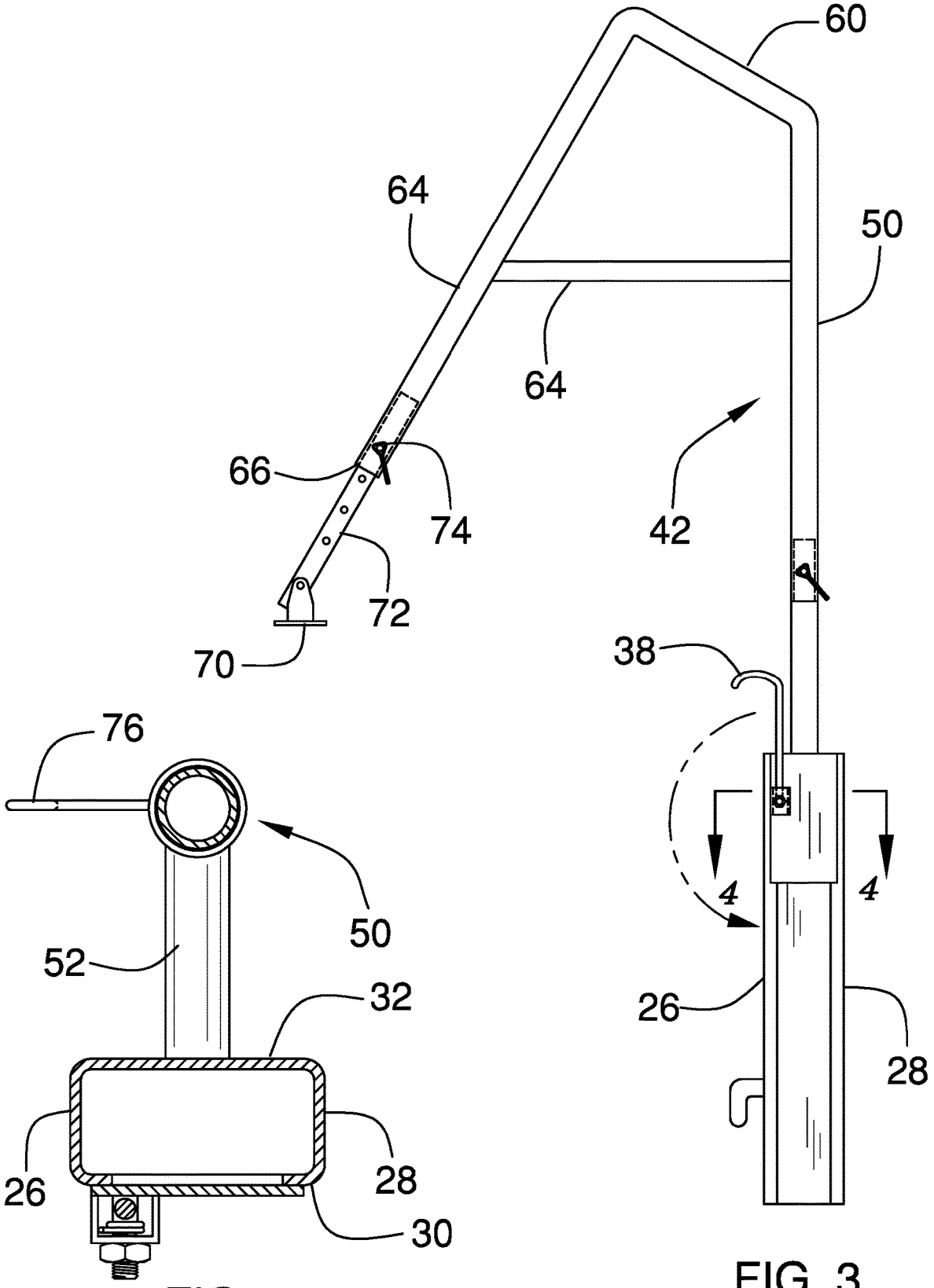
FIG. 3 is a right side view of an embodiment of the disclosure.
FIG. 4 is a cross-sectional view of an embodiment of the disclosure taken along line 4-4 of FIG. 3.

The stabilizer 42 includes a vertical post 50 that extends upwardly from the sleeve 12. The vertical post 50 may be attached to the sleeve 12 by one or more rods 52 as is shown in FIG. 1. The vertical post 50 has an apex 54 positioned above the upper end 16 of the sleeve 12 by at least 12.0 inches. As can be seen in FIG. 2, the vertical post 50 may be provided sections 56 attached together by pins 58 to allow the vertical post 50 to come apart for storage and transportation purposes. An arm 60 is attached to the apex 54 and extends forward and upwardly from the vertical post 50 so that the arm 60 forms an obtuse angle of between 100° and 150° with the vertical post 50. The arm 60 has a distal end 62 with respect to the vertical post 50. A leg 64 is attached to the arm 60 and extends forward and downwardly from the distal end 62. The leg 64 has a free end 66. An angle formed between the leg 64 and arm 60 may be between 80° and 110°. It should be understood that an arc may be formed at the junctures of the vertical post 50 and the arm 60, and the arm 60 and the leg 64 and furthermore the arm 60 may be arcuate. A brace 68 may be provided that is attached to and extends between the leg 64 and the vertical post 50.

A foot 70 is attached to the stabilizer 42 and is configured to enhance friction between the stabilizer 42 and the roof 44. The foot 70 is pivotally coupled to the free end 66 of the leg. More specifically, the foot 70 may be attached to an extension member 72 that is received by the free end 66 so that a distance between the foot 70 and the free end 66 may be adjusted. A locking pin 74 retains the extension member 72 at a selected position relative to the leg 64.

Figure 6:
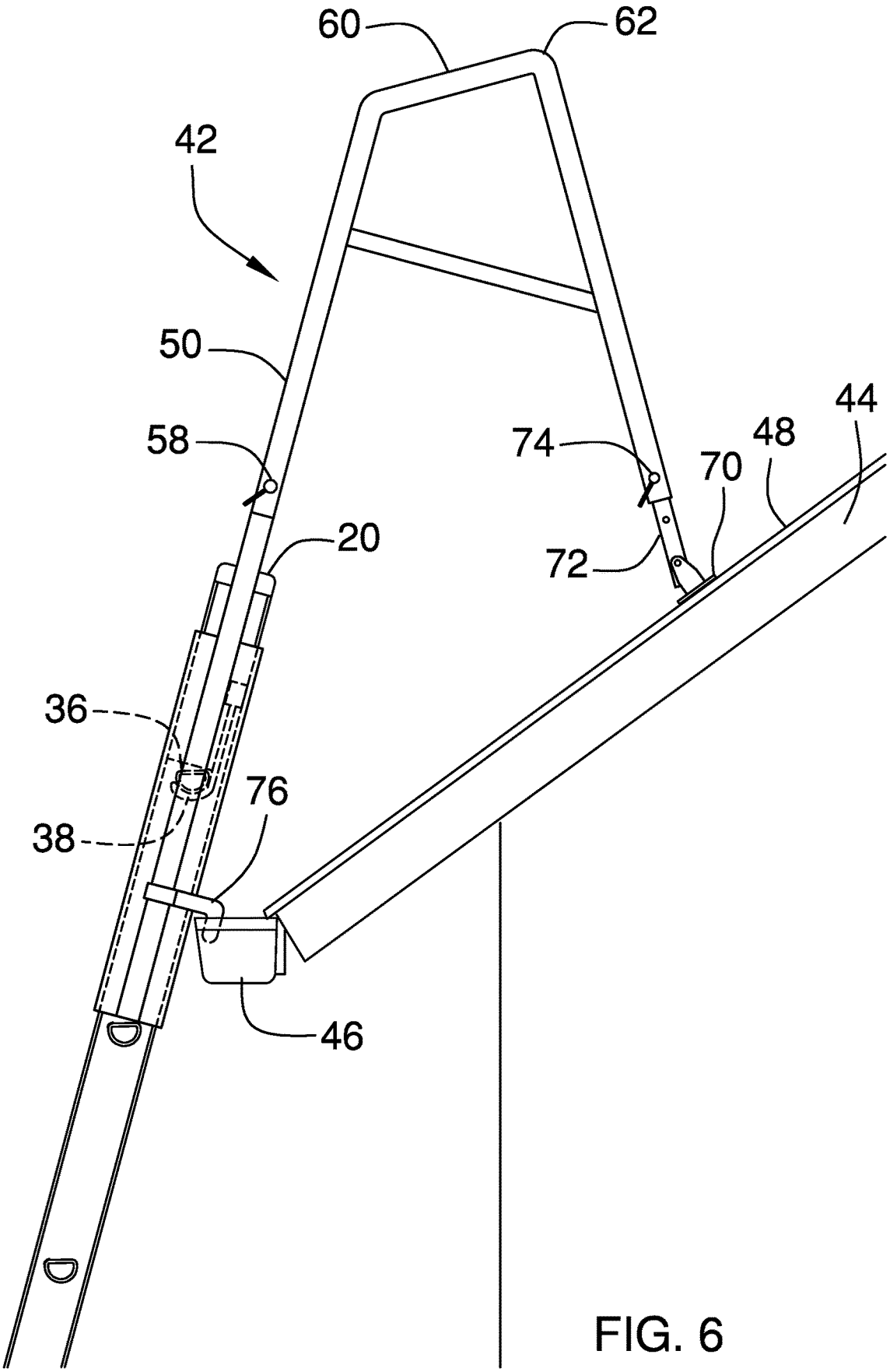
FIG. 6 is a left side view of an embodiment of the disclosure.

A catch 76 is attached to the stabilizer 42 and is configured to engage the gutter 46 positioned on the roof 44. The catch 76 is positioned on the vertical post 50 and located distal to the apex 54 of the vertical post 50. As can be seen in FIG. 6, the catch 76 provides additional stabilizing forces between the ladder 22 and the roof 44.

Figure 5:
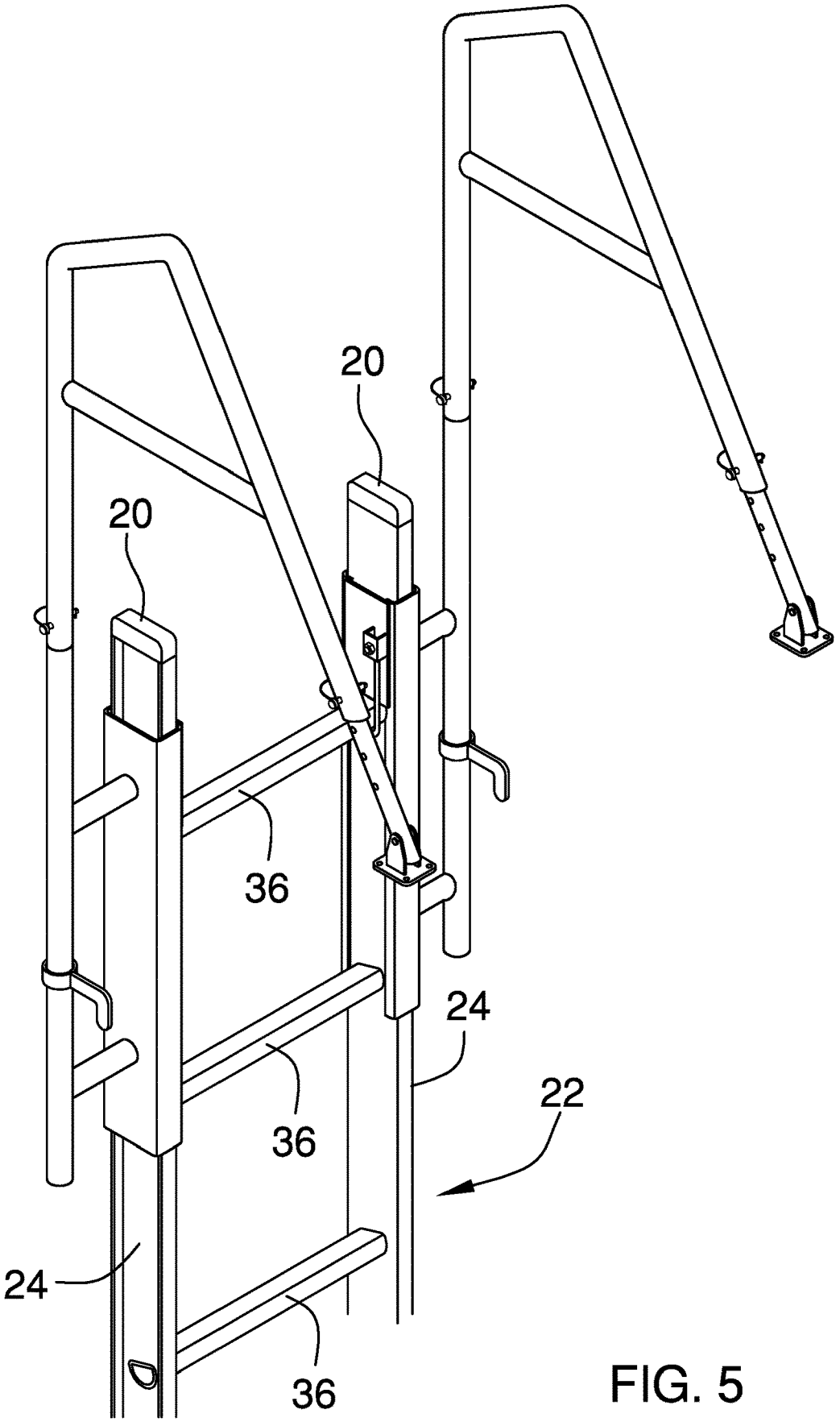
FIG. 5 is a front isometric view of an embodiment of the disclosure.

In use, the assembly 10 is attached to the ladder 22 as stated above. However, as can be seen in FIG. 5, typically a pair of the assemblies 10 is utilized wherein each side rail of the ladder 22 is inserted into one of the assemblies 10. As such, the assemblies 10 come in a "left" and "right" version though because the stabilizers 42 are modular, they can be rotated as needed. When the assemblies 10 are positioned on the ladder 22, the ladder 22 is placed against the edge of the roof 44 or gutter 46 in a conventional manner and the feet 70 positioned on the roof 44. The feet 70 and catch 76 prevent the ladder 22 from easily moving laterally and thereby provide more stability for the user of the ladder 22. Furthermore, the stabilizer 42 itself may act as a handhold should the user be moving onto or off from the roof 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A ladder stabilization assembly configured to releasably engage a ladder and be abutted against a roof, the assembly comprising:

a sleeve including an outer wall having an upper end and a lower end, the lower end being open and being configured to receive a top end of a ladder side rail;

a coupler being mounted to the sleeve, the coupler being configured to releasable engage a ladder rung;

a stabilizer being attached to the sleeve, the stabilizer being positionable on a roof to stabilize a ladder engaged with the sleeve, the stabilizer extending upwardly and forwardly of the sleeve, wherein the stabilizer includes a vertical post extending upwardly from the sleeve, the vertical post having an apex, an arm being attached to the apex and extending forward and upwardly from the vertical post, the arm having a distal end with respect to the vertical post, and a leg being attached to the arm and extending forward and downwardly from the distal end, the leg having a free end; and a catch being attached to the stabilizer and being configured to engage a gutter positioned on the roof, the catch being positioned on the vertical post.

2. The ladder stabilization assembly according to claim 1, wherein the coupler is positioned nearer to the upper end than the lower end.

3. The ladder stabilization assembly according to claim 2, wherein the coupler comprises a hook having an attached end being rotatably coupled to the sleeve.

4. The ladder stabilization assembly according to claim 1, wherein the stabilizer is positioned on the sleeve opposite of the coupler.

5. The ladder stabilization assembly according to claim 1, wherein said stabilizer further includes a brace being attached to and extending between the leg and the vertical post.

6. The ladder stabilization assembly according to claim 5, further including a foot being attached to the stabilizer and being configured to enhance friction between the stabilizer and the roof, the foot being pivotally coupled to the free end of the leg.

7. The ladder stabilization assembly according to claim 1, further including a foot being attached to the stabilizer and being configured to enhance friction between the foot and the roof.

8. A ladder stabilization assembly configured to releasably engage a ladder and be abutted against a roof, the assembly comprising:

a sleeve including an outer wall having an upper end and a lower end, the lower end being open and being configured to receive a top end of a ladder side rail;

a coupler being mounted to the sleeve, the coupler being configured to releasable engage a ladder rung, the coupler being positioned nearer to the upper end than the lower end, the coupler comprising a hook having an attached end being rotatably coupled to the sleeve;

a stabilizer being attached to the sleeve, the stabilizer being positionable on a roof to stabilize a ladder engaged with the sleeve, the stabilizer extending upwardly and forwardly of the sleeve, the stabilizer being positioned on the sleeve opposite of the coupler, the stabilizer including:

a vertical post extending upwardly from the sleeve, the vertical post having an apex;

an arm being attached to the apex and extending forward and upwardly from the vertical post, the arm having a distal end with respect to the vertical post;

a leg being attached to the arm and extending forward and downwardly from the distal end, the leg having a free end;

a brace being attached to and extending between the leg and the vertical post;

a foot being attached to the stabilizer and being configured to enhance friction between the stabilizer and the roof, the foot being pivotally coupled to the free end of the leg; and a catch being attached to the stabilizer and being configured to engage a gutter positioned on the roof, the catch being positioned on the vertical post, the catch being positioned distal to the apex of the vertical post.

* * * * *